US009907131B2

(12) United States Patent
Kong et al.

(10) Patent No.: US 9,907,131 B2
(45) Date of Patent: Feb. 27, 2018

(54) ARBITRARY PULSE ALIGNMENT TO REDUCE LED FLICKER

(71) Applicant: DIALOG SEMICONDUCTOR INC., Campbell, CA (US)

(72) Inventors: Lingxin Kong, Campbell, CA (US); Nailong Wang, Campbell, CA (US); Ze Han, Campbell, CA (US)

(73) Assignee: DIALOG SEMICONDUCTOR INC., Campbell, CA (US)

( * ) Notice: Subject to any disclaimer, the term of this patent is extended or adjusted under 35 U.S.C. 154(b) by 0 days.

(21) Appl. No.: 15/615,662

(22) Filed: Jun. 6, 2017

(65) Prior Publication Data

US 2017/0290115 A1 Oct. 5, 2017

Related U.S. Application Data

(63) Continuation of application No. 14/807,171, filed on Jul. 23, 2015, now Pat. No. 9,674,911.

(51) Int. Cl.

| | |
|---|---|
| ***H05B 33/08*** | (2006.01) |
| ***G09G 3/32*** | (2016.01) |
| ***G09G 3/3208*** | (2016.01) |
| ***G09G 3/34*** | (2006.01) |

(52) U.S. Cl.

CPC ..... *H05B 33/0827* (2013.01); *G09G 3/32* (2013.01); *G09G 3/3208* (2013.01); *G09G 3/342* (2013.01); *G09G 3/3406* (2013.01); *G09G 3/3426* (2013.01); *H05B 33/0845* (2013.01); *G09G 2310/08* (2013.01); *G09G 2320/0247* (2013.01); *G09G 2320/064* (2013.01)

(58) Field of Classification Search

None

See application file for complete search history.

(56) References Cited

U.S. PATENT DOCUMENTS

| | | | | |
|---|---|---|---|---|
| 5,570,276 | A | 10/1996 | Cuk | |
| 6,115,017 | A | 9/2000 | Mikami | |
| 9,071,134 | B2 | 6/2015 | Harriman | |
| 9,131,581 | B1 * | 9/2015 | Hsia | H05B 33/086 |
| 2008/0116871 | A1 | 5/2008 | Li | |
| 2009/0096392 | A1 | 4/2009 | Chandran | |
| 2010/0188444 | A1 * | 7/2010 | Okuyama | G09G 3/2025 345/691 |
| 2011/0012658 | A1 | 1/2011 | Hsieh | |
| 2012/0229432 | A1 | 9/2012 | Ueno | |
| 2014/0266136 | A1 | 9/2014 | Krishnamurthy | |
| 2015/0338763 | A1 | 11/2015 | Azumai | |

* cited by examiner

*Primary Examiner* — Crystal L Hammond

(74) *Attorney, Agent, or Firm* — Haynes and Boone, LLP

(57) ABSTRACT

An arbitrary alignment is provided for a series of pulses controlling a switch that in turn controls a current in an LED. Each pulse is generated according to a target time responsive to a reference time in a corresponding cycle of a synchronization clock. Each pulse has a leading portion that precedes its target time and a trailing portion subsequent to its target time. The arbitrary alignment defines the relative size of the leading portion to the trailing portion such that these relative sizes are incrementally changed across successive ones of the pulses.

20 Claims, 6 Drawing Sheets

ARBITRARY PULSE ALIGNMENT TO REDUCE LED FLICKER

CROSS-REFERENCE TO RELATED APPLICATIONS

This application is a continuation of U.S. application Ser. No. 14/807,171, filed Jul. 23, 2015.

TECHNICAL FIELD

This application relates to a light-emitting diode (LED) system, and more particularly to an arbitrary pulse alignment for pulses that control a luminous intensity of the LED system.

BACKGROUND

In the past, light-emitting diodes (LED)s were substantially more expensive than alternative technologies such as cold cathode fluorescent lamp (CCFL) backlighting. However, modern mass production and advances in manufacturing have made LEDs much less expensive. Given their lack of toxic components in contrast to the mercury used in CCFL as well as their increased efficiency, LED backlighting is thus rapidly replacing older technologies such as CCFL. One issue that remains with regard to the adoption of LED technology is LED flicker.

In particular, flicker may occur in systems that use pulse width modulation (PWM) to control the LED dimming (relative brightness). In contrast, a constant current reduction dimming approach would instead change the amount of current driven into an LED string. But such a change in current level results in a change of the color temperature and also tends to produce a non-linear change in luminosity. In contrast, PWM dimming keeps the color temperature substantially constant and results in a linear dimming profile. PWM dimming control is thus a popular alternative to a constant current reduction approach. But the resulting flicker in PWM-dimmed systems may discourage a consumer's adoption of LED technology. This is detrimental to the environment given the increased greenhouse gas emissions associated with the relatively-poor efficiency of alternative lighting technologies and their associated toxic waste.

Accordingly, there is a need in the art for improved LED PWM dimming methods and systems that eliminate flicker.

SUMMARY

An LED system is disclosed in which a PWM controller controls the pulse width of a stream of pulses used to pulse a switch controlling current through an LED. Depending upon the duty cycle for the pulse stream, the LED provides a corresponding luminous intensity. As the duty cycle (pulse width) decreases, the luminous intensity produced by the LED is dimmed accordingly. The PWM controller generates each pulse responsive to a reference time determined from a corresponding cycle of a synchronization clock The PWM controller generates each pulse such that it has a leading portion that precedes a target time defined with regard to the reference time in the corresponding cycle of the synchronization clock and such that the pulse has a trailing portion subsequent to the pulse target time. The pulse's target time equals the reference time in the corresponding cycle of the synchronization clock plus a specified delay. The leading portion of each pulse equals some arbitrary factor (m %) of its pulse width. The remaining trailing portion thus equals n % of the pulse width, where n equals (1-m).

Should the m % for a pulse equal 0%, the pulse's rising edge aligns with the pulse's target time. Such an alignment corresponds to a conventional head alignment mode in which the rising edge of each pulse occurs at the pulse's target time. Conversely, if the m % for a pulse equals 100%, the pulse's falling edge aligns with the pulse's target time. Such an alignment corresponds to a conventional tail alignment mode (which may also be designated as a falling edge alignment mode).

It is conventional for a PWM controller to switch modes from a head alignment to a tail alignment or vice-versa. But such mode switches are associated with undesirable flicker in the luminous intensity for the corresponding LED string. The PWM controller disclosed herein may increment or decrement the m % (and hence also the n %) on a pulse-by-pulse basis when switching between head and tail alignment modes to suppress undesirable flicker. The flicker suppression and additional advantageous properties of the resulting LED system may be better appreciated through a consideration of the following detailed description.

BRIEF DESCRIPTION OF THE DRAWINGS

Embodiments of the present disclosure and their advantages are best understood by referring to the detailed description that follows. It should be appreciated that like reference numerals are used to identify like elements illustrated in one or more of the figures.

DETAILED DESCRIPTION

An arbitrary pulse alignment technique is provided that eliminates LED flicker. This pulse alignment technique is denoted as "arbitrary" in that the alignment is neither a rising edge (head) alignment nor a falling edge (tail) alignment but instead some combination of both modes. A head alignment mode and a tail alignment mode are both conventional. In a head alignment mode, the rising edge of each pulse used in a pulse width modulation dimming occurs at a target time having some specified delay after a corresponding reference time such as the rising edge of a synchronization clock controlling the period of the resulting pulse width modulation. In contrast, a conventional tail alignment occurs when the falling edge of the pulses occur a specified delay after the corresponding reference time. The PWM pulses disclosed herein are also generated with regard to a target time defined by a reference time in a corresponding cycle of the synchronization clock. But in contrast to conventional head and tail alignment schemes, the arbitrary pulse alignment technique disclosed herein uses a leading portion of the pulse width for each pulse that precedes the pulse's target time and a remaining trailing portion of the pulse width subsequent to the pulse's target time, wherein the relative sizes of the leading and trailing portions are varied by a percentage of the pulse width across successive ones of the pulses.

Figure 1:
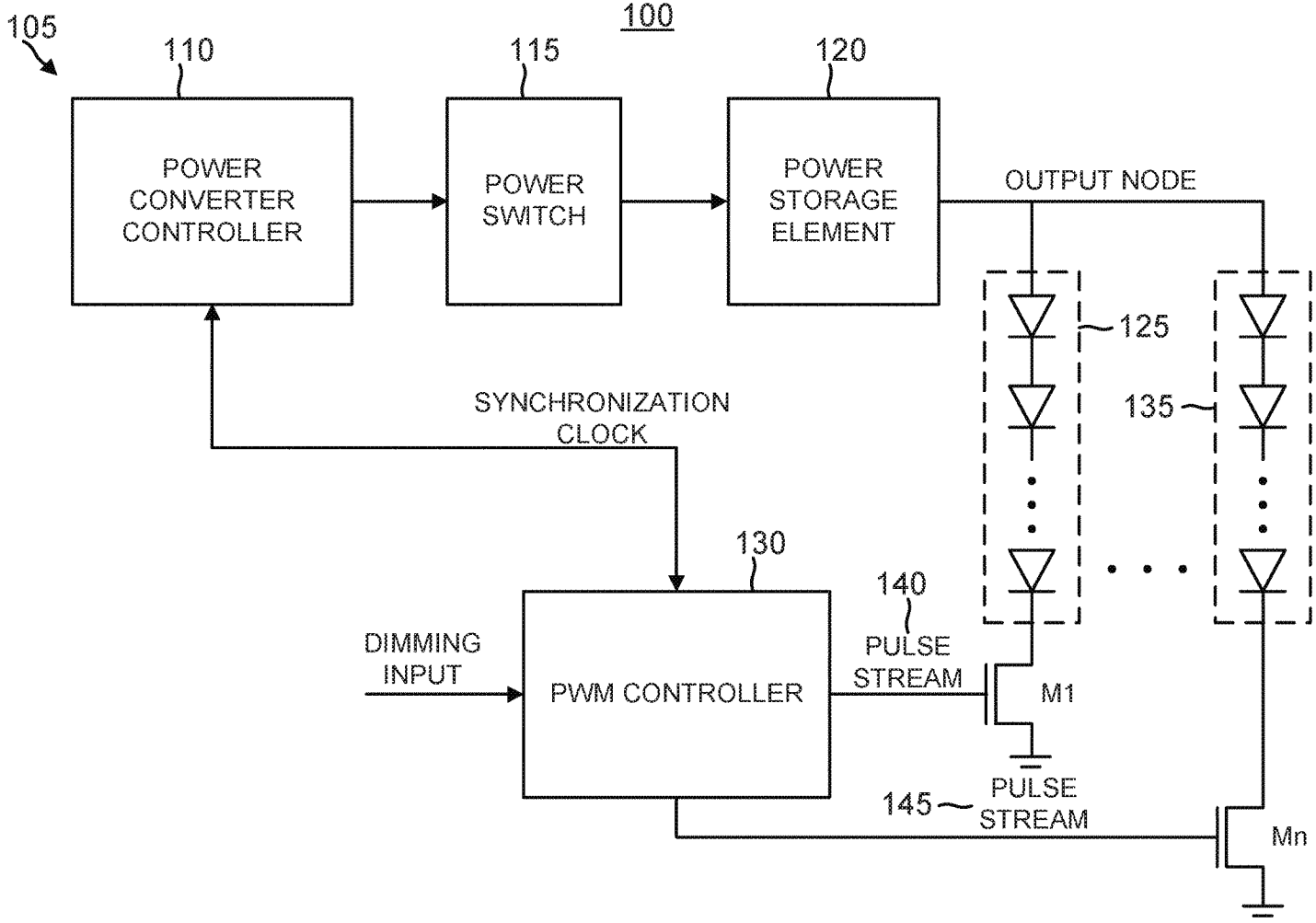
FIG. 1 is a diagram of an example LED system in accordance with an embodiment of the disclosure.

An example LED system 100 with arbitrary pulse alignment is shown in FIG. 1. A switching power converter 105 includes a switching power converter controller 110 that controls the switching of a power switch 115 to in turn control the storage of power in a power storage element 120. The stored power within power storage element 120 is released responsive to the switching of power switch 115 to provide regulated power such as a constant current to a first LED string 125. Switching power converter 105 may comprise any suitable power converter such a buck converter, a boost converter, or a flyback converter. More generally, switching power converter 105 may comprise any suitable DC-DC or AC-DC power converter. The input voltage and feedback loop for switching power converter 105 is not shown for illustration simplicity. Regardless of its specific architecture, switching power converter 105 may be configured to maintain a constant voltage across first LED string 125 or to drive a constant current into first LED string 125. Should first LED string 125 be coupled directly to ground, it would produce a constant luminance as maintained by the constant power output from switching power converter 105.

To provide dimming control for LED string 125, a pulse width modulation (PWM) controller 130 controls the switching of a switch such as an NMOS transistor M1 that couples between first LED string 125 and ground. Depending a dimming input such as generated by the needs of a display backlight by first LED string 125, PWM controller 130 determines the duty cycle (pulse width) for a pulsed voltage signal (pulse stream) 140 that drives the gate of transistor M1. PWM controller 130 generates pulsed voltage signal 140 responsive to a synchronization clock that determines the period for the pulse width modulation. For example, suppose the dimming input indicates that a minimum LED output power is desired. PWM controller 130 would then produce a pulse of a minimum width in each period of the synchronization clock. More generally, the pulse width in each period of the synchronization clock may be varied from this minimum value to a maximum value depending upon the dimming input. Note that the synchronization clock may actually have a higher frequency than the pulse repetition frequency for pulse stream 140 produced by PWM controller 130. For example, PWM controller 130 may respond to every other cycle of the synchronization clock with regard to producing a corresponding pulse in pulse stream 140. The pulse repetition frequency would then be one-half of the synchronization clock frequency in such an embodiment. More generally, the pulse repetition frequency may be some integer fraction of the synchronization clock frequency. Alternatively, the pulse repetition frequency may equal the synchronization clock frequency.

To provide an ability to vary the luminous intensity from first LED string 125 without undesirable flicker, PWM controller 130 generates pulses 140 so that a leading portion (designated herein as "m %" of the pulse width, where m is an arbitrary number that may even be negative or exceed 100) of each pulse precedes a target time for the pulse. The target time is defined with regard to some specified delay from the reference time in the corresponding cycle of the synchronization clock. A remaining trailing portion of each pulse, denoted herein as n %, follows the pulse's target time. The sum of m % and n % must of course equal 1 (together they add up to the entire pulse width) such that n equals (100-m). It is conceptually easier to consider an embodiment in which the synchronization clock frequency and the pulse repetition frequency are the same. The following discussion will thus assume that these frequencies are equal without loss of generality. In such embodiments, each cycle of the synchronization clock triggers a corresponding pulse such that there is a one-to-one relationship between synchronization clock cycles and pulses in pulse stream 140. Either the rising edge or the falling edge of the synchronization clock in a given clock cycle may be used to determine the reference time used for the timing of the corresponding pulse. The following discussion will thus assume that the rising edge of the synchronization clock defines the reference times without loss of generality. Each rising edge of the synchronization clock would then trigger a corresponding pulse so long as PWM controller 130 continued to use the rising edges as the reference times. PWM controller 130 generates each pulse with reference to a target time equaling the pulse's reference time plus a specified delay (which may be negative in some embodiments such that the target time actually precedes the corresponding reference time). As noted earlier, a conventional head alignment mode arises when the rising edge of each pulse coincides with the pulse's target time whereas a tail alignment mode aligns the falling edge of each pulse with its target time. As will be explained further herein, the arbitrary pulse alignment technique implemented by PWM controller 130 enables PWM controller 130 to readily switch between the tail alignment mode and the head alignment mode without causing perceptible flicker. In contrast, conventional pulse alignment techniques typically suffer from flicker as the mode of operation switches from a head alignment mode to a tail alignment mode or vice-versa.

LED system 100 is a multi-string embodiment such that there is a plurality of n (n being an integer greater than one) LED strings ranging from first LED string 125 to an nth LED string 135. Power converter 105 may include multiple stages for driving these various strings or may drive them in common from a single stage. In a multi-stage converter, each stage may include its own power switch 115 and power storage element 120. These stages may then drive in common the output node coupled to all the LED strings. In a multi-string embodiment, each LED string couples to ground through a corresponding switch such as an NMOS transistor ranging from transistor M1 for first LED string 125 to an nth NMOS transistor Mn for nth LED string 135. PWM controller 130 generates a corresponding pulse stream to control the gate of each transistor M1 through Mn. In one embodiment, PWM controller may be configured to independently control the on/off time and pulse widths for each LED string such that each LED string receives a unique stream of pulses. A pulse stream 145 for nth LED string 135 would thus be different from pulse stream 140 for first LED string 125 in such independently-controlled embodiments. In other embodiments, subsets of the LED strings may share a common pulse stream. In yet additional embodiments, all the LED strings may share a common pulse stream from PWM controller 130.

Figure 2:
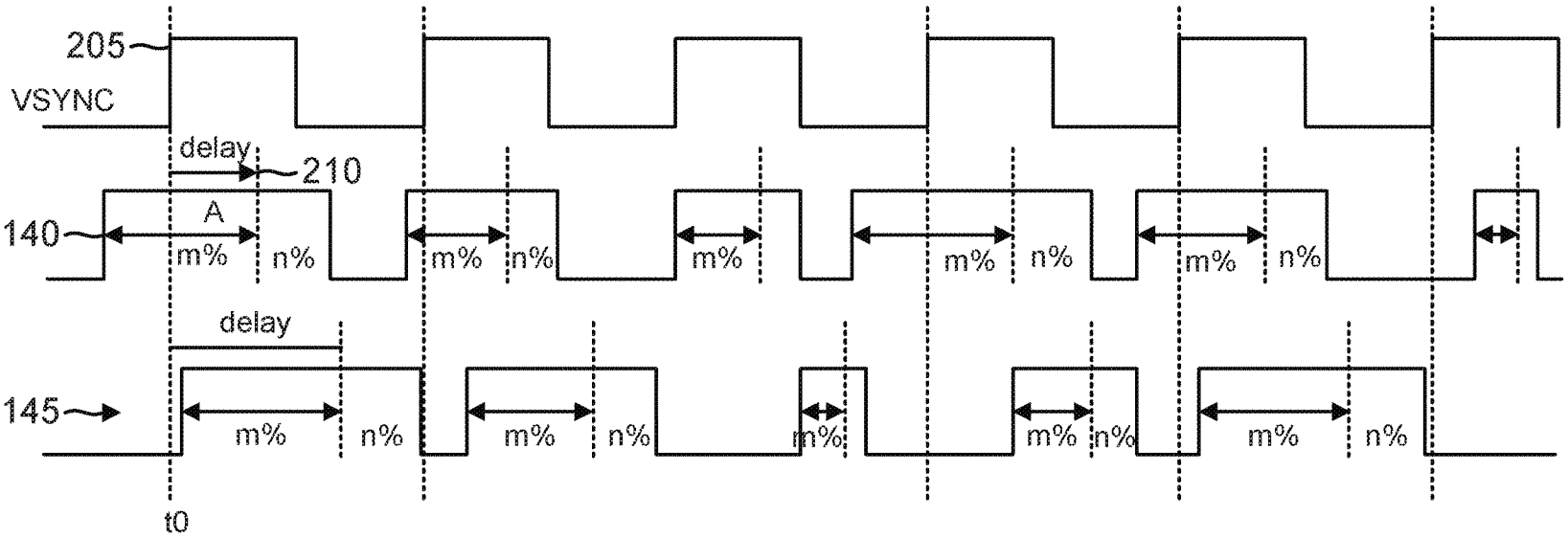
FIG. 2 illustrates two example pulse streams having an arbitrary alignment defined with regard to each pulse's target time as produced by the PWM controller in the LED system of FIG. 1.

Examples of pulse streams 140 and 145 produced according to an arbitrary alignment technique practiced by PWM controller 130 are shown in FIG. 2. The corresponding cycles 205 of the synchronization clock (VSYNC) are also illustrated. In this embodiment, the frequency of the synchronization clock and the pulse streams are the same. Each cycle of the synchronization clock thus controls the reference time for a corresponding pulse. In this embodiment's mode of operation, the reference time is the rising edge in each synchronization clock but the falling edge may be used as the reference time in other modes of operation. Responsive to the dimming input command, PWM controller 130 determines a corresponding pulse width for each LED string such as for pulse streams 140 and 145. In addition, PWM controller determines the leading portion (m %) for each pulse (which also determines the trailing portion n % since n % equals (1-m)%. The m % is substantially equal to 75% for each pulse in pulse streams 140 and 145 but as will be discussed below, the m % may be varied on a pulse-to-pulse basis to suppress flicker. Moreover, m % may vary across the different channels corresponding to different LED strings.

PWM controller 130 is configured to operate so that the leading portion (the m % of the pulse width) of each pulse precedes the pulse's target time, which equals the reference time from the corresponding cycle of the synchronization clock plus a specified delay. This specified delay may be the same for each pulse stream or may vary from pulse stream to pulse stream. In the embodiment shown in FIG. 2, pulse width is varied for pulse streams 140 and 145 on a pulse-by-pulse basis for illustration purposes. In general, the rate of change from pulse to pulse for the pulse width will depend upon the dimming command driving PWM controller 130. Regardless of the individual pulse width, note that m % of the pulse width precedes the pulse's target time for that pulse and that n % of the pulse width trails the pulse's target time. For example, consider an initial pulse A in pulse stream 140. The reference time from the rising edge for the corresponding synchronization clock cycle for pulse A is designated as time to. The m % and n % for pulse A are determined with regard to its target time equaling t0 plus the specified delay (t0+delay). Each successive pulse has its own target time from which the corresponding m % and n % pulse width portions are defined.

Figure 3:
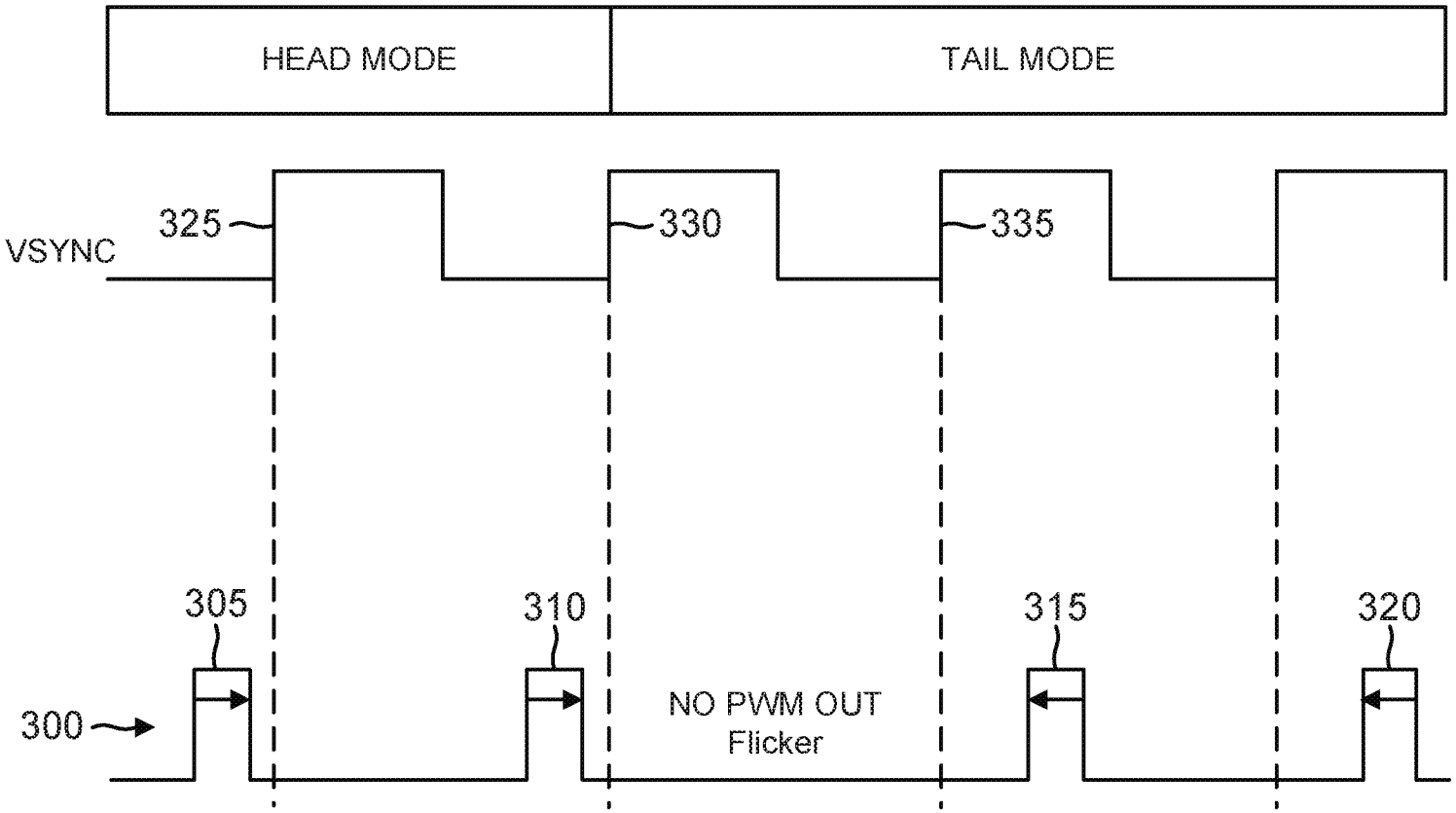
FIG. 3 illustrates a conventional pulse stream that causes flicker when switching from a head alignment mode to a tail alignment mode due to a missing pulse.

Referring again to PWM controller 130, note that a conventional PWM controller is also configured to generate pulses with regard to a target time for each pulse. As noted earlier, if the rising edge of the pulse coincides with the pulse's target time, the alignment mode may be referred to as a head alignment mode since it is the head of the pulse that has the timing relationship (the specified delay) with regard to the reference time in the corresponding cycle of the synchronization clock. In contrast, should the falling edge of a conventional pulse coincide with its target time, the alignment mode may be referred to as a tail alignment mode since it is the tail of the pulse that has the timing relationship with the reference time. In backlighting applications, it is conventional to switch periodically from a head alignment mode to a tail alignment mode. Such mode switches are often associated with flicker. For example, consider the conventional pulse train 300 of FIG. 3. During a first set of pulses 305 and 310, the alignment mode is a head alignment mode. In contrast, a tail alignment mode is applied to a subsequent set of pulses 315 and 320. During the head alignment mode, the specified delay with regard to the rising edge of a synchronization clock 325 is actually negative such that the rising edge of each corresponding cycle of synchronization clock follows the rising edge of pulses 305 and 310 by the specified delay. This delay is then made positive for tail mode pulses 315 and 320. Head mode pulse 310 occurs responsive to the rising edge 330, whereupon the alignment mode changes. There is thus no pulse generated in the synchronization clock cycle between rising edges 330 and 335. The resulting absence of a pulse is then detected by a viewer of a display being backlit by a LED string being dimmed responsive to pulse train 300 as an undesirable flicker because the LED string will suddenly have no light output in the synchronization clock period between rising edges 330 and 335.

A complementary situation for flicker from conventional pulse alignment techniques can also arise (a brief increase in brightness as compared to the brief absence of light from pulse train 300). For example, consider a conventional pulse train 400 shown in FIG. 4. During the head mode, the delay time is positive whereas it is negative for the tail mode. A rising edge 415 of a synchronization clock 401 separates the head and tail alignment modes. A preceding clock edge 420 in the head alignment mode will thus trigger a pulse 405 that extends to a time A just before rising clock edge 415. In turn, rising clock edge 415 triggers a tail mode pulse 410 that begins at time point B, prior to time A. The result is that head mode pulse 405 merges with tail mode pulse 410. If pulse train 400 controls the dimming of a LED string backlighting a display, a viewer may see the increased pulse width as a temporary increase in brightness (an undesirable flicker).

Figure 5:
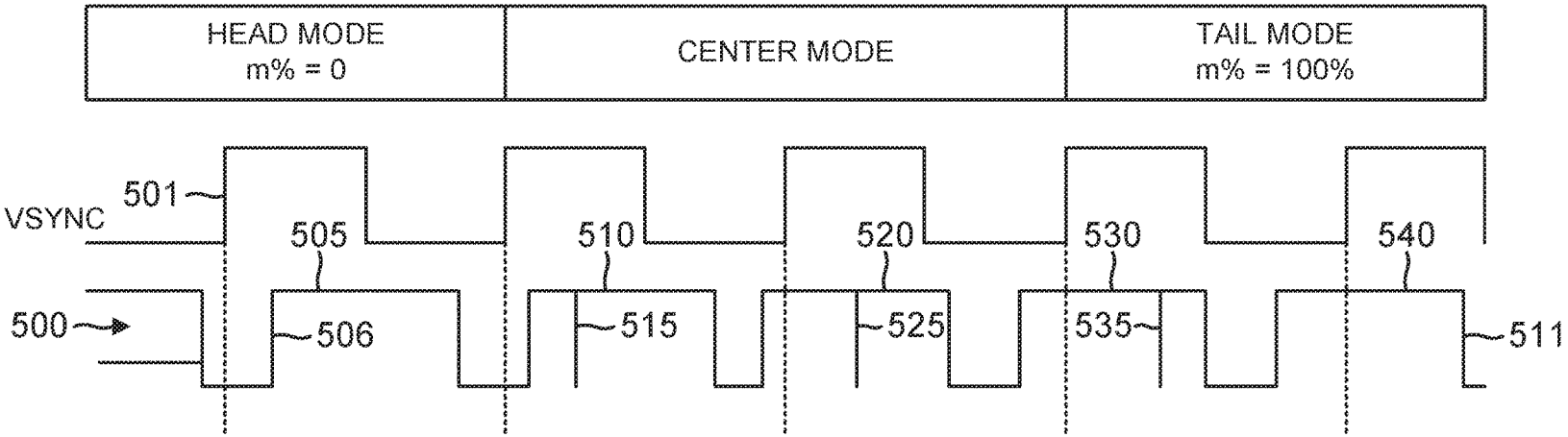
FIG. 5 illustrates a pulse stream having an incremented arbitrary alignment with regard to each pulse's target time during the transition from a head alignment mode to a tail alignment mode in accordance with an embodiment of the disclosure.

But such flicker is eliminated in head/tail mode transitions for LED system 100. For example, PWM controller 130 may be configured to change the m % in increments on a pulse-by-pulse basis during a transition from head mode alignment to tail mode alignment. Similarly, PMW controller 130 may be configured to change the m % (so as to either decrease or increase a current leading portion relative to a preceding leading portion) on a pulse-by-pulse basis during a transition from tail mode alignment to head mode alignment. Regardless of the mode alignment, the resulting transition between modes is advantageously flicker-free. An example transition in which the leading portion is incremented is shown in FIG. 5 for a pulse train 500. An initial pulse 505 occurs during a head alignment mode such that a corresponding target time 506 aligns with a leading edge of pulse 505. A final pulse 540 occurs during a tail alignment mode such that a corresponding target time 511 aligns with the trailing edge of pulse 540. Each pulse's target time is defined with regard to a reference time defined by a corresponding cycle of a synchronization clock 501 such as the rising edge of synchronization clock 501 in each cycle. In particular, the pulse target time equals the reference time plus a specified delay as discussed previously. Note that the specified delay depends upon the mode of operation. In pulse stream 500, the specified delay is shorter during the head mode of operation whereas it is longer during the tail mode of operation. However, the delays may be the same or may be larger for the head mode as compared to the tail mode for alternative embodiments. Moreover, the delay may be changed on a pulse-by-pulse basis regardless of the mode of operation.

Figure 4:
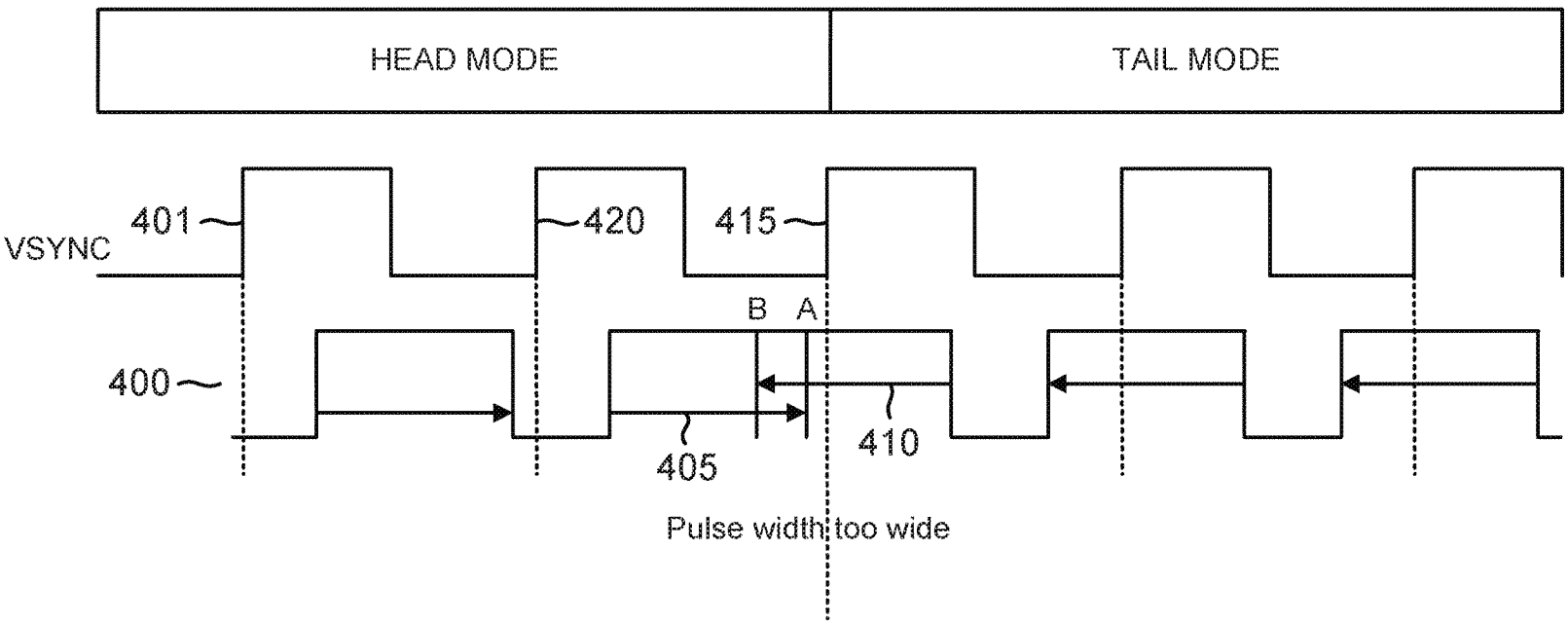
FIG. 4 illustrates a conventional pulse stream that causes flicker when switching from a head alignment mode to a tail alignment mode due to a pulse having an excessive pulse width.

If pulse 505 were immediately followed by pulse 540 as occurs in a conventional transition from head mode to tail mode, the resulting pulses would overlap analogously as discussed with regard to FIG. 4. A user viewing a display backlit by an LED string having its brightness dimmed responsive to such an overlapped pulse may then perceive an undesirable sudden increase in brightness. But this flicker is prevented by pulse train 500 since the head mode is followed by a "center" mode in which the m % is incremented on a pulse-by-pulse basis. For example, an initial pulse 510 in the center mode has an m % of approximately 25% as defined with regard to its target time 515. Similarly, a subsequent pulse 520 has an m % of approximately 50% as defined with regard to its target time of 525. A final pulse 530 in the center mode of operation has an m % of approximately 75% as defined with regard to its target time 535.

Due to this incremental advance in m % across the pulses in the center mode of operation, each successive pulse has a rising edge that is more and more advanced in time as compared to the rising edge (reference time) in the corresponding cycle of synchronization clock 501, For example, final center mode pulse 530 is advanced in timing by 75% of its pulse width with regard to its target time 535. It will thus have no overlap with tail mode pulse 540. In this fashion, the overlap problem discussed with regard to FIG. 4 is solved. Note that PWM controller 130 may also adjust the specified delay for each pulse as necessary to further suppress flicker in addition to incrementing the m %. In a transition from tail mode to head mode, PWM controller 130 would decrement the m % accordingly. Advantageously, the missing pulse flicker discussed with regard to FIG. 3 would also be suppressed. In such a case of a relatively low duty cycle in which the delay is negative during the head mode, the rising edge of each successive pulse during the center mode of operation would be more and more delayed with regard to the pulse's reference time due to the progressive increase in m % across the pulses. Conversely, the rising edge of each pulse would be more and more advanced in a transition from tail mode to head mode such that no missing pulse would be produced.

Figure 6:
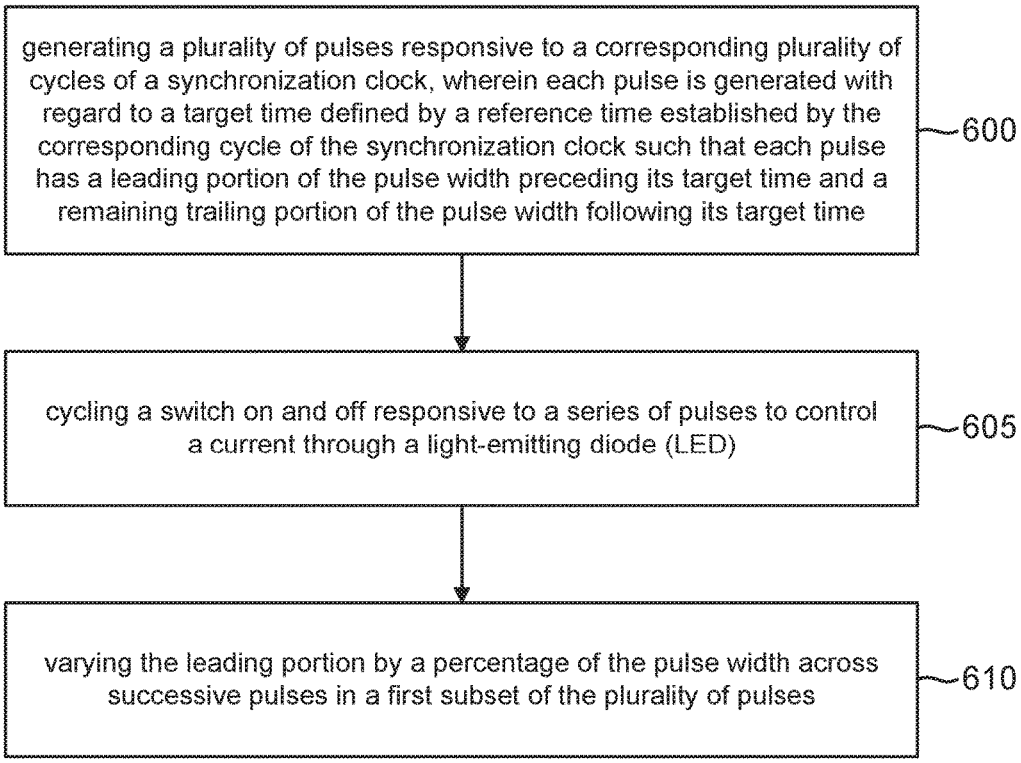
FIG. 6 is a flowchart for an example method of incrementing the arbitrary alignment of a pulse stream in accordance with an embodiment of the disclosure.

An example method of operation for arbitrary pulse alignment will now be discussed with regard to the flowchart of FIG. 6. The method includes an act 600 of generating a plurality of pulses responsive to a corresponding plurality of cycles of a synchronization clock, wherein each pulse is generated with regard to a target time defined by a reference time established by the corresponding cycle of the synchronization clock such that each pulse has a leading portion of the pulse width preceding its target time and a remaining trailing portion of the pulse width following its target time. The generation of pulse trains 140 and 145 discussed above is an example of act 600. The method further includes an act 605 of cycling a switch on and off responsive to a series of pulses to control a current through a light-emitting diode (LED). The cycling of transistors MI or Mn of LED system 100 is an example of act 605. Finally, the method includes an act 610 of varying the leading portion by a percentage of the pulse width across successive pulses in a first subset of the plurality of pulses. The incrementing of the leading portions in successive pulses during the center mode discussed with regard to FIG. 5 is an example of act 610.

As those of some skill in this art will by now appreciate and depending on the particular application at hand, many modifications, substitutions and variations can be made in and to the materials, apparatus, configurations and methods of use of the devices of the present disclosure without departing from the scope thereof. For example, alternative detectors as compared to the use of a comparator may be used with regard to determining if the power switch should be cycled to bolster the controller power supply voltage. In light of this, the scope of the present disclosure should not be limited to that of the particular embodiments illustrated and described herein, as they are merely by way of some examples thereof, but rather, should be fully commensurate with that of the claims appended hereafter and their functional equivalents.

We claim:

1. A system, comprising:

a light-emitting diode (LED);

a switch configured to control a current through the LED responsive to the switch cycling on and off; and a pulse width modulation (PWM) controller configured to generate a plurality of pulses responsive to a corresponding plurality of cycles of a synchronization clock to control the cycling of the switch, each pulse having a pulse width, wherein the PWM controller is further configured to generate each pulse responsive to a target time defined with regard to a reference time in the corresponding cycle of the synchronization clock such that the pulse has a leading portion of the pulse width that precedes its target time and such that the pulse has a trailing portion of the pulse width subsequent to its target time, and wherein the PWM controller is further configured to change the leading portion by a percentage of the pulse width across successive pulses in a first subset of the plurality of pulses.

2. The system of claim 1, wherein the PWM controller is configured to change the leading portion so as to decrement the leading portion by the percentage of the pulse width across the successive pulses in the first subset of the plurality of pulses.

3. The system of claim 1, wherein the PWM controller is configured to change the leading portion so as to increment the leading portion by the percentage of the pulse width across the successive pulses in the first subset of the plurality of pulses.

4. The system of claim 1, wherein the LED comprises a string of LEDs.

5. The system of claim 1, further comprising:

a switching power converter configured to drive a constant current into the LED while the switch is cycled on responsive to each pulse in the plurality of pulses.

6. The system of claim 5, wherein the switching power converter comprises a buck converter.

7. The system of claim 5, wherein the switching power converter comprises a boost converter.

8. The system of claim 5, wherein the switching power converter comprises a flyback converter.

9. The system of claim 1, wherein the PWM controller is configured to operate in a head alignment mode in which each pulse in a second subset of the pulses has a rising edge aligned with the pulse's target time, and wherein the PWM controller is further configured to operate in a tail alignment mode in which each pulse in a third subset of the pulses has a falling edge aligned with the pulse's target time, and wherein the PWM controller is further configured to change the leading portion by a percentage of the pulse width across successive pulses in the first subset of the plurality of pulses during a mode shift between the head alignment mode and the tail alignment mode.

10. The system of claim 1, wherein the LED is configured to backlight a display.

11. The system of claim 1, wherein the PWM controller is further configured so that the leading portion of each pulse for a second subset of the pulses may comprise a negative percentage of the pulse width.

12. A method, comprising:

generating a plurality of pulses responsive to a corresponding plurality of cycles of a synchronization clock, wherein each pulse is generated with regard to a target time defined by a reference time established by the corresponding cycle of the synchronization clock such that each pulse has a leading portion of the pulse width preceding its target time and a remaining trailing portion of the pulse width following its target time;

cycling a switch on and off responsive to a series of pulses to control a current through a light-emitting diode (LED); and varying the leading portion by a percentage of the pulse width across successive pulses in a first subset of the plurality of pulses.

13. The method of claim 12, wherein varying the leading portion comprises incrementing the leading portion by the percentage of the pulse width across the successive pulses in the first subset of the plurality of pulses.

14. The method of claim 12, wherein varying the leading portion comprises decrementing the leading portion by the percentage of the pulse width across the successive pulses in the first subset of the plurality of pulses.

15. The method of claim 12, wherein the reference time in each cycle of the synchronization clock comprises a rising edge of the synchronization clock.

16. The method of claim 12, wherein the reference time in each cycle of the synchronization clock comprises a falling edge of the synchronization clock.

17. The method of claim 12, wherein the synchronization clock has a first frequency, and wherein a pulse repetition frequency for the plurality of pulses is different from the first frequency.

18. The method of claim 12, wherein the synchronization clock has a first frequency, and wherein a pulse repetition frequency for the plurality of pulses is the same as the first frequency.

19. The method of claim 12, further comprising back-lighting a display responsive to light generated by the LED while the switch is cycled on.

20. The method of claim 12, wherein the LED comprises a string of LEDs.

* * * * *